US006398674B2

(12) United States Patent
Tsuchida

(10) Patent No.: US 6,398,674 B2
(45) Date of Patent: Jun. 4, 2002

(54) GUT-CLAMPING MECHANISM IN GUT-STRETCHING EQUIPMENT FOR TENNIS RACKETS

(76) Inventor: Akira Tsuchida, 7-45, 2-chome, Hachiman-cho, Higashikurume City, Tokyo (JP), 203-0042

( * ) Notice: Subject to any disclaimer, the term of this patent is extended or adjusted under 35 U.S.C. 154(b) by 0 days.

(21) Appl. No.: 09/836,063

(22) Filed: Apr. 16, 2001

(30) Foreign Application Priority Data

May 2, 2000 (JP) ..... 12-133242

(51) Int. Cl.[7] ..... A63B 51/14
(52) U.S. Cl. ..... 473/557
(58) Field of Search ..... 473/555, 556, 473/557; 269/86, 166, 169

(56) References Cited

U.S. PATENT DOCUMENTS 3,441,275 A * 4/1969 Held ..... 473/556
3,635,080 A * 1/1972 Krueger et al. ..... 473/556
4,376,535 A * 3/1983 Muselet et al. ..... 473/556
5,090,697 A * 2/1992 Lee ..... 473/555
6,093,121 A * 7/2000 Bishop et al. ..... 473/557

FOREIGN PATENT DOCUMENTS

FR 2551351 * 9/1983

* cited by examiner

*Primary Examiner*—Raleigh W. Chiu
(74) *Attorney, Agent, or Firm*—Johnson & Stainbrook, LLP; Larry D. Johnson; Craig M. Stainbrook

(57) ABSTRACT

A gut-clamping mechanism for use in stringing tennis, badminton, squash, and racquetball rackets. The apparatus includes a support post erected on a clamp block, a pair of holders wherein one holder is secured onto the top edge of said support post and the other holder is provided on the first holder in a detachable manner and such that an expanding coil spring is inserted between them. A pressing plate that has a shaft that goes through the pair of holders when the holders are joined together and with a fastening, adjusting nut hinged on the screw unit that is etched and provided at the tip of said shaft. A clamp handle is axially attached to an edge of the pressing plate, wherein a freely rotating roller is axially attached to the part that comes into contact with the side of the holder secured onto the support post in the clamp handle.

2 Claims, 5 Drawing Sheets

GUT-CLAMPING MECHANISM IN GUT-STRETCHING EQUIPMENT FOR TENNIS RACKETS

CROSS REFERENCE TO RELATED APPLICATIONS

The present application claims the benefit of the filing date of Japanese Patent Application Serial No. 2000-13242, filed May 2, 2000.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to sports racket stringing equipment, and more particularly to a gut-clamping mechanism in gut-stretching equipment for tennis rackets, squash rackets, badminton rackets, racquetball rackets, and the like.

BACKGROUND INFORMATION

Clamp handles for racket stringing equipment are designed to open and close a pawl by employing a sliding action. In many cases, these clamp handles employ the principles of metal bearings, wherein expensive materials, such as copper and brass, are used in the clamp handle 101H. In the other holder 101C, the part A that serves as the receptacle for the other holder quenched steel is mirror-surface polished and fitted in for maximum sliding efficiency, such that the wear occurs mostly on the handle, so as to protect the main unit.

Therefore, in addition to the high material cost of the clamp handle 101H, the other holder 101C that receives the clamp handle requires a fortifying material and labor, which adds to the high cost.

The present invention was developed in view of the above situation, the purpose thereof being to provide an inexpensive and light-weight gut-clamping mechanism for tennis rackets and the like that uses a roller to reduce the wear on the mutual contact point between the clamp handle and the holders so that inexpensive materials, such as light alloys and plastics, can be used for the construction of the clamp handle. This eliminates the need for a reinforcing means on the holder side that comes into contact with the clamp handle.

BRIEF SUMMARY OF THE INVENTION

The gut-clamping mechanism of the present invention generally comprises a support post erected on a clamp block, a pair of holders wherein one holder is secured onto the top edge of the support post and the other holder is provided on the first holder in a detachable manner, such that an expanding coil spring is inserted between them, a pressing plate having a shaft that goes through the pair of holders when the screw unit that is etched and provided at the tip of the shaft, and a clamp handle that is axially attached to an edge of the pressing plate. A freely rotating roller is axially attached to the contact part with the side of the holder that is secured onto the support post in the clamp handle.

DETAILED DESCRIPTION OF THE INVENTION

Figure 1:
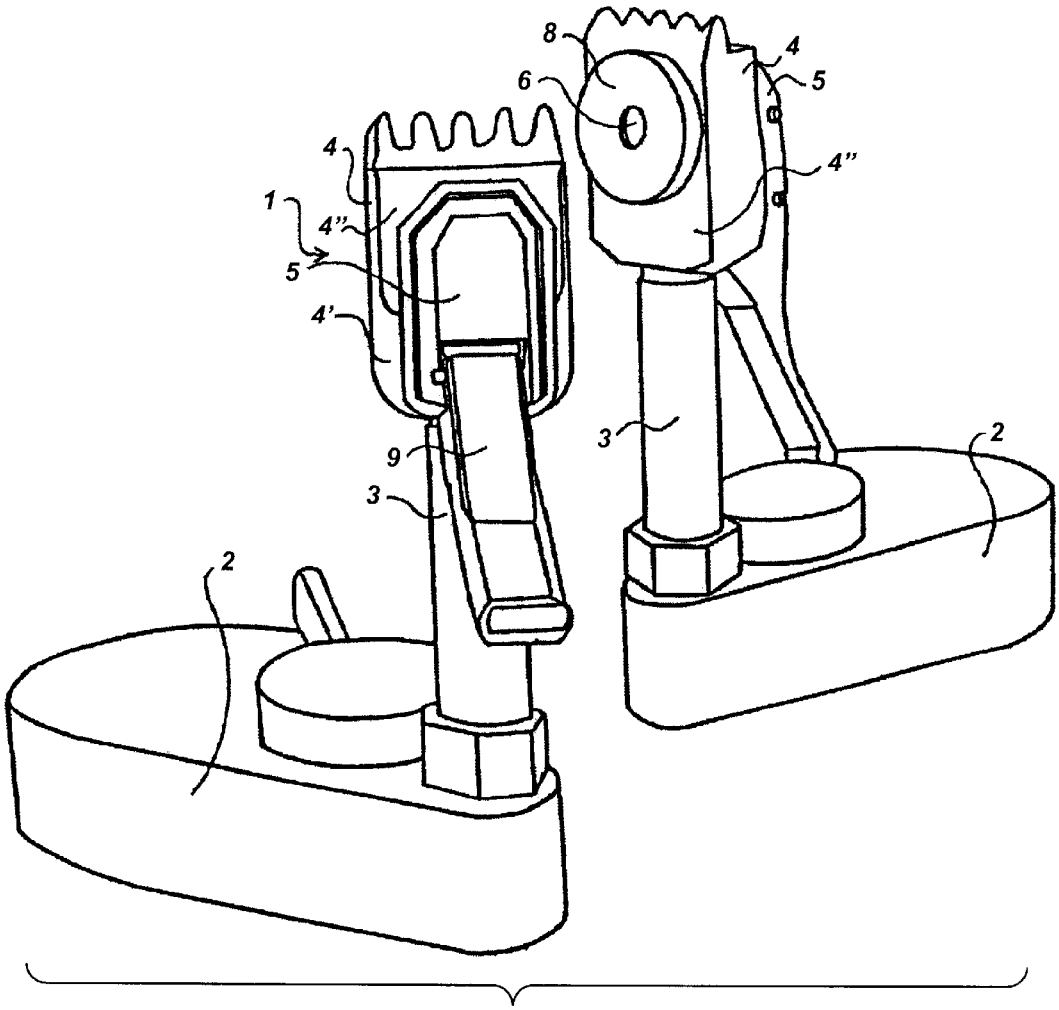
FIG. 1 is perspective view of an embodiment of the present invention.
Figure 2:
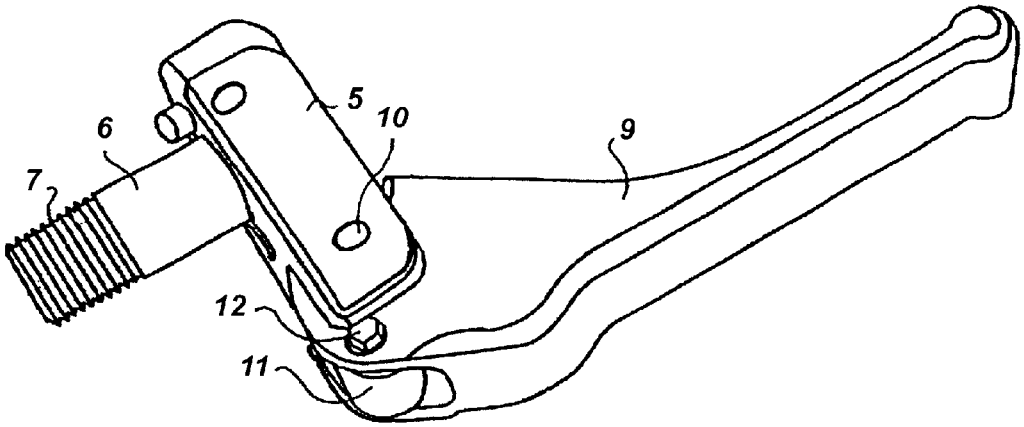
FIG. 2 is a perspective view of the clamp handle.
Figure 3:
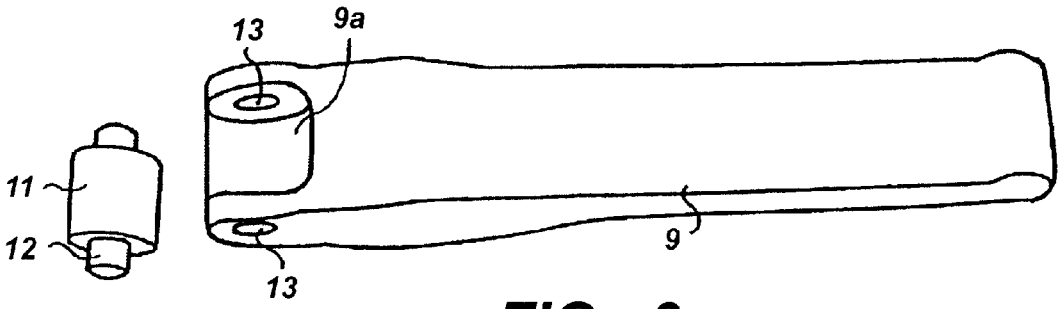
FIG. 3 is a perspective view of the clamp handle of FIG. 2 with the roller removed.
Figure 4:
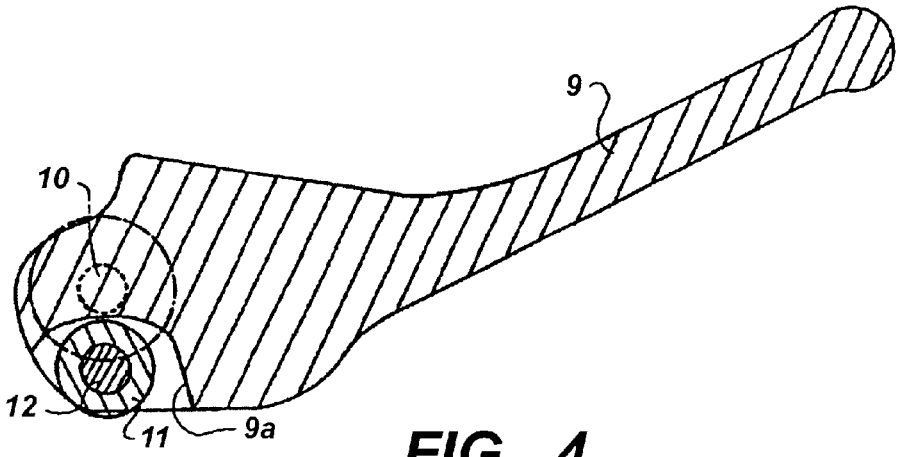
FIG. 4 is a cross-section side view in elevation of the clamp handle of FIGS. 2 and 3.
Figure 5:
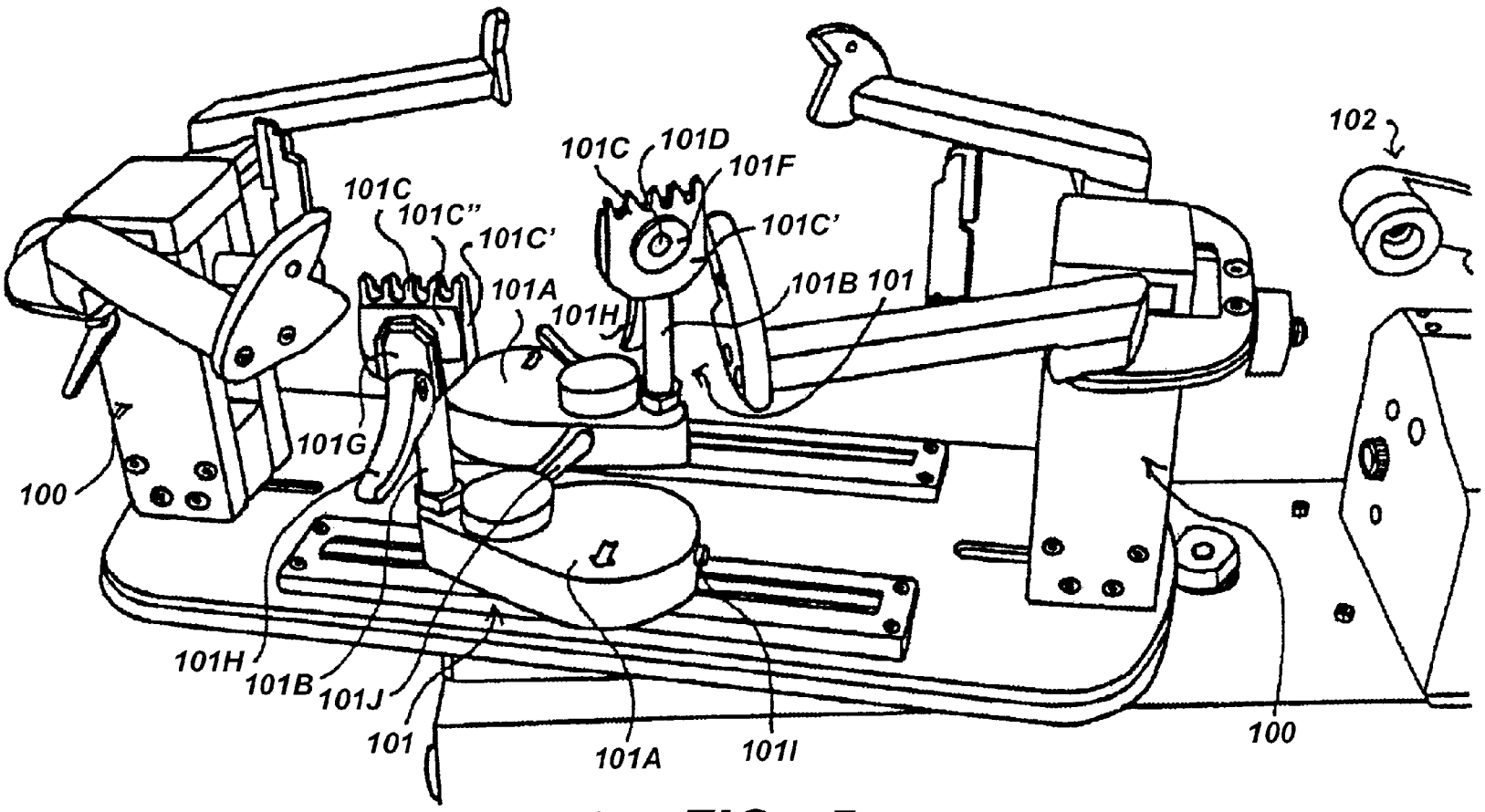
FIG. 5 is a perspective view of an stringing apparatus employing the gut stretching mechanism of the present invention.
Figure 6:
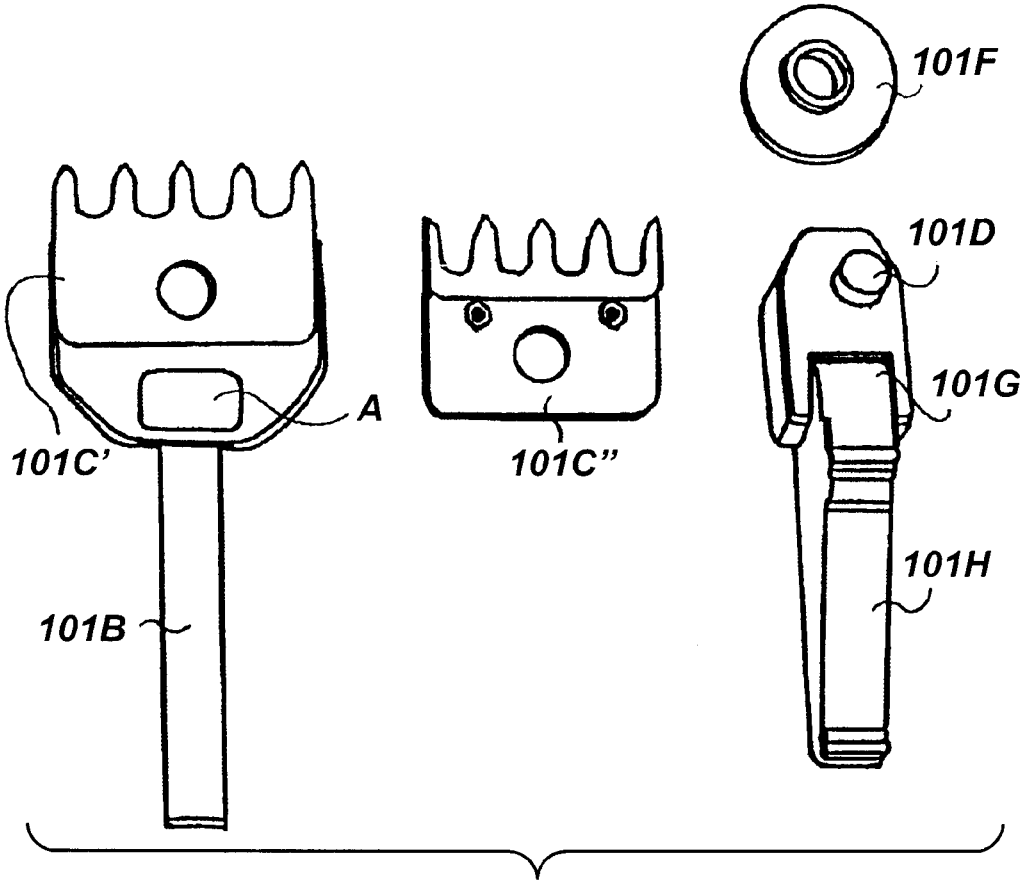
FIG. 6 is an orthographic exploded assembly view of one of the pair of holders of the gut clamping mechanism.
Figure 7:
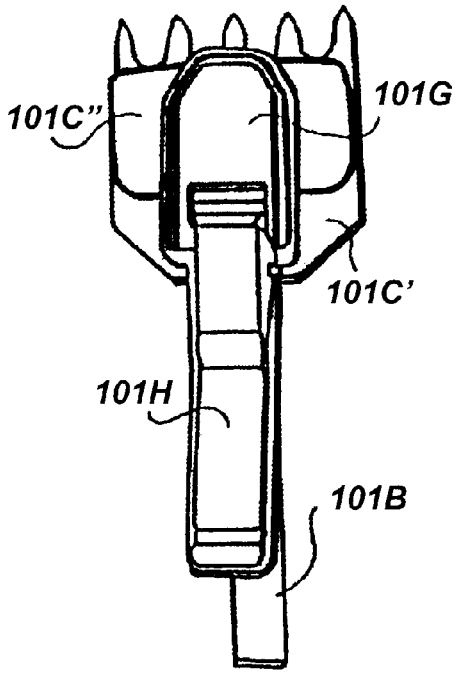
FIG. 7 shows a holder assembled and mounted on a support spot.

Referring to FIGS. 1 through 8, wherein like reference numerals refer to like components in the various views, FIG. 1 is perspective view of an embodiment of the present invention; FIG. 2 is a perspective view of the clamp handle; FIG. 3 is a perspective view of the clamp handle of FIG. 2 with the roller removed; and FIG. 4 is a center cross-section side view in elevation of the clamp handle of FIGS. 2 and 3.

In FIGS. 1–4, Reference Number 1 denotes a gut-clamping mechanism; 2, a clamp block; and 3, a support post that is erected on the clamp block 2.

Similarly, Reference Number 4 denotes a pair of holders consisting of 4' and another holder 4". One of the holders, 4', is secured onto the top edge of the aforementioned post through a shaft (more on this later). An expanding coil spring (not shown in the figure) is inserted between these holders 4' and 4", and the spring is always energized in an opening direction. The holders 4' and 4" are provided with through-holes (not shown in the figure) for the shaft (more on this later)

Reference Number 5 denotes a pressing plate; it has a shaft 6 that goes through the pair of holders 4 when they are joined together. Hinged on a screw 7 that is etched and provided at the tip of the shaft 6 is a fastening adjusting nut 8.

Reference Number 9 denotes a clamp handle that is axially attached to one end of the pressing plate 5 by means of an axis 10.

Figure 8:
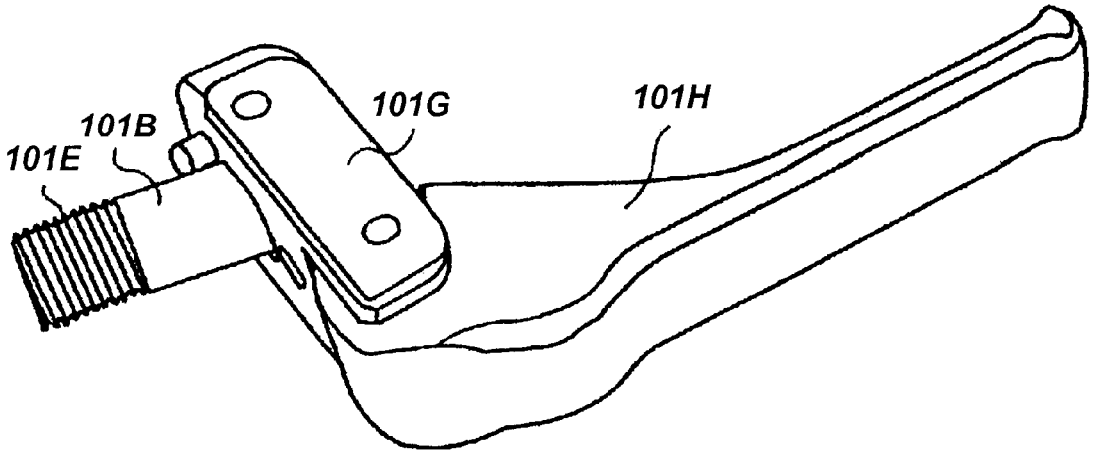
FIG. 8 is a perspective view showing detail of the clamp handle.

The above structure is the same as a conventional gut-clamping mechanism. A feature of the present invention lies in the provision of a freely rotating roller 11 in the section (part A in FIG. 8 illustrating the aforementioned conventional mechanism) that comes into aforementioned clamp handle 9. Similarly, Reference Number 12 denotes a rotary axis for the roller and 13 denotes a rotary axis insertion hole that is provided on the sidewall of the roller receptacle recess 9*a* on the clamp handle 9.

In this mechanism, when the clamp handle 9 is held down in order to clamp a gut by means of the holders 4, the roller 11 axially attached to the clamp handle 11 moves and rotates one of the holders 4', thus preventing any strong friction between the holders, as would occur in the conventional structure. In this manner, the wear between the two contact surfaces can be minimized.

FIGS. 5 through 8 show that the gut-stretching equipment for tennis and badminton rackets of the present invention generally comprises a racket anchor block 100; a gut-clamping mechanism 101; and a tension unit 102 that stretches catgut with a prescribed pressure.

In said equipment, the gut-clamping mechanism 101 consists of the following components: a clamp block 101A that can freely move right and left along a guide rail (not shown in the figure); a support spot 101B that is erected on the clamp block 101A; a pair of holders 101C wherein one holder, 101C, is fixed onto the top edge of said support post and the other holder, 101C and wherein an expanding coil spring (not shown in the figure) is inserted between them; a pressing plate 101G that has a shaft 101D that goes through said pair of holders 101C when they are joined together as well as a fastening, adjusting nut 101F at a screw unit 101E that is etched and provided at the tip of said shaft 101D; and a clamp handle 101H that is axially installed on one edge of said pressing plate 101G. In addition, Reference Number 101I denotes a pressure-adjusting screw for the clamp block 101A and the rail; and 101J denotes a lever that secures the clamp block 101A onto the rail.

The present invention consists of the above-described constitution and action. As such, by axially attaching a freely rotating roller to the clamp handle, the friction between the contacting faces on the clamp handle and one of the holders can be minimized. This permits the use of inexpensive materials, such as light alloys and plastics, for the clamp handle, and eliminates the need for reinforcing means on the side of the holder that comes into contact with the roller, thereby substantially reducing costs and as well as the weight. This also eliminates the need for maintenance, such as the application of lubrication oil. Most significantly, the weight reduction substantially improves the performance of the entire clamping mechanism, which is used extremely frequently (stretching a racket involves dozens of tightening and releasing operations).

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A gut-clamping mechanism, comprising:

a support post erected on a clamp block;

a pair of holders wherein one holder is secured onto the top edge of said support post and the other holder is provided on the first holder in a detachable manner, such that an expanding coil spring is inserted between them;

a pressing plate with a shaft having a tip, said shaft going through said pair of holders when the holders are joined together and with a fastening, adjusting nut hinged on the screw unit that is etched and provided at said tip of said shaft; and a clamp handle that is axially attached to an edge of said pressing plate; and a freely rotating roller axially attached to the contact part that comes into contact with the side of the holder secured onto the support post in the clamp handle.

2. A gut-clamping apparatus for use in gut-stretching equipment for stringing tennis rackets, badminton rackets, squash rackets, and racquetball rackets, said apparatus comprising:

a racket anchor block;

a gut-clamping mechanism having a clamp block that moves right and left along a guide rail, a support post erected on the clamp block and having a top edge, a first holder and a second holder, wherein said first holder is fixed onto said top edge of said support post and said second holder, and wherein an expanding coil spring is inserted between said first and said second holders, a pressing plate with a shaft through said first and second holders when said holders are joined together, a fastening, adjusting nut at a screw unit etched and provided at said tip of said shaft, a clamp handle that is axially installed on one edge of said pressing plate, a pressure-adjusting screw for the clamp block and the rail, and a lever that secures said clamp block onto said rail; and a tension unit for stretching catgut with a prescribed pressure.

* * * * *